United States Patent [19]

Baillet et al.

[11] Patent Number: 4,940,163

[45] Date of Patent: Jul. 10, 1990

[54] WIRING ACCESSORY DISPENSER

[75] Inventors: Alain Baillet, Montville; Francois Loisel, Maromme; Daniel Paulin, Bosc le Hard, all of France

[73] Assignee: Legrand, Limoges, France

[21] Appl. No.: 305,639

[22] Filed: Feb. 3, 1989

[30] Foreign Application Priority Data

Feb. 5, 1988 [FR] France ..... 88 01356

[51] Int. Cl.[5] ..... B65H 1/00

[52] U.S. Cl. ..... 221/193; 221/185; 221/191; 221/281; 221/307; 221/312 C; 29/809; 81/177.4; 206/338; 206/328

[58] Field of Search ..... 221/185, 191, 193, 281, 221/303, 307, 309, 312 R, 312 A, 312 B, 312 C; 29/270, 811, 809; 206/328, 332, 338, 525, 526; 81/177.4; 140/106

[56] References Cited

U.S. PATENT DOCUMENTS

| | | | |
|---|---|---|---|
| 3,672,738 | 6/1972 | Buttriss | 29/811 X |
| 4,581,481 | 4/1986 | Moretti | 29/811 X |
| 4,733,460 | 3/1988 | Auger et al. | 221/312 C X |

FOREIGN PATENT DOCUMENTS

| | | |
|---|---|---|
| 0186914 | 7/1986 | European Pat. Off. . |
| 2193920 | 2/1988 | United Kingdom . |

*Primary Examiner*—Michael S. Huppert
*Assistant Examiner*—David H. Bollinger
*Attorney, Agent, or Firm*—Charles E. Brown; Charles A. Brown

[57] ABSTRACT

A dispenser for wiring accessories has an elongate plate-like configuration and comprises a baseplate from which projects a bar extending transversely across the baseplate to a width less than the width of the baseplate. A longitudinal groove in the bar parallel to the baseplate runs the full length of the bar. A lip faces the longitudinal edge of the bar into which the groove opens. The lip is parallel to and spaced from this longitudinal edge. The baseplate is extended at one end of the bar. A transverse cradle on this extension receives a wiring accessory and a longitudinal finger projects cantilever-fashion from the bar over the cradle and is spaced from the cradle to retain a wiring accessory in the cradle.

17 Claims, 2 Drawing Sheets

WIRING ACCESSORY DISPENSER

BACKGROUND OF THE INVENTION

Field of the invention

The present invention is generally concerned with wiring accessories designed to be fitted to the previously stripped end of the stranded conductive core of an electrical conductor to facilitate and render more secure the connection of the conductor to a terminal.

The wiring accessories, usually referred to as terminal connectors, may incorporate an eyelet or a forked or plain tab for making the connection and some types, through which direct connection to the conductor core is made, incorporate an insulative collar.

They include a metal shank to be crimped onto the conductive core end and must first be fitted to the latter.

Although supplying wiring accessories in strip form was proposed long ago, the accessories routinely available on the market at this time are usually supplied loose in bulk.

They must therefore be taken one by one from a container as required and when executed manually this operation is made all the more difficult in that the wiring accessories are comparatively small.

In any event, this operation inevitably wastes time and it can also lead to non-negligible wastage of wiring accessories if these are dropped when picked out of the container.

A general object of the present invention is a dispenser to facilitate fitting a wiring accessory to the end of a conductive core and which has further advantages.

SUMMARY OF THE INVENTION

The present invention consists in a dispenser for wiring accessories having an elongate plate-like configuration and comprising a baseplate, a bar projecting from said baseplate and extending transversely across said baseplate to a width less than that of said baseplate, a longitudinal groove in said bar parallel to said baseplate and running the full length of said bar, a lip facing the longitudinal edge of said bar into which said groove opens, parallel to and spaced from said longitudinal edge, an extension of said baseplate at one end of said bar, a transverse cradle on said extension adapted to receive a wiring accessory and a longitudinal finger projecting cantilever-fashion from said bar over said cradle and spaced therefrom adapted to retain a wiring accessory in said cradle.

If required the dispenser in accordance with the invention may be used in isolation, especially when the wiring accessories to be fitted are initially loose in bulk or when, supplied in strip form, they are readily detachable from the strip by simple tearing.

It is then advantageously possible to load it with wiring accessories in advance, in the workshop for example.

By virtue of its dispensing function it advantageously facilitates the fitting of the wiring accessories with the benefit of saving time in the corresponding operation.

The necessary manipulation no longer applies to the wiring accessory itself but rather to the dispenser accommodating the wiring accessories which is easier to handle, in particular because it is larger.

In this case the finger provided for this purpose advantageously retains the wiring accessories one by one as they reach the underlying cradle.

However, the dispenser in accordance with the invention may equally well be used as an adapter or loader for a crimping tool which, like that which is the subject matter of another application filed this day, incorporates crimping jaws for crimping a wiring accessory once the latter has been fitted to the conductive core end.

In this case the finger provided for this purpose retains the wiring accessory in the underlying cradle, as previously, whether the wiring accessory is obtained individually from a supply loose in bulk or whether, the wiring accessory initially forming part of a strip, a cutting blade provided to this end in one of the crimping jaws enables them to be detached one by one and it is the last one in the strip.

The characteristics and advantages of the invention will emerge from the following description given by way of non-limiting example only with reference to the appended schematic drawings.

DESCRIPTION OF THE PREFERRED EMBODIMENTS

Figure 1:
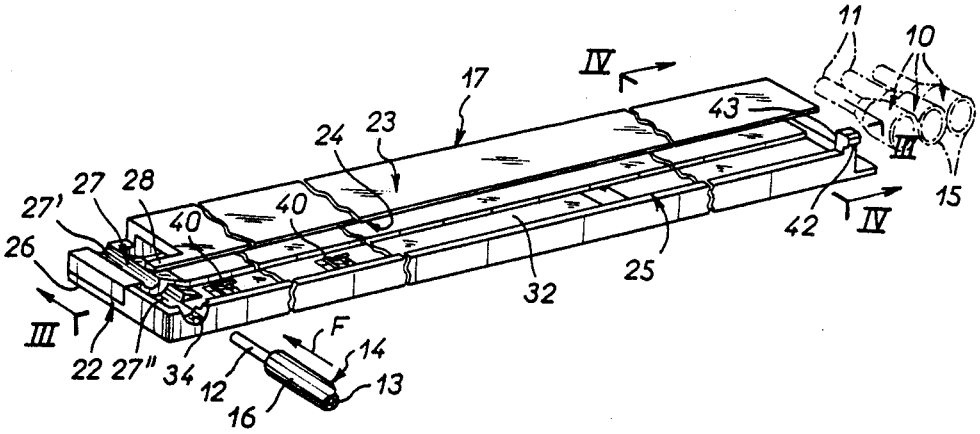
FIG. 1 is a perspective view as seen from above of a dispenser in accordance with the invention.
Figure 2:
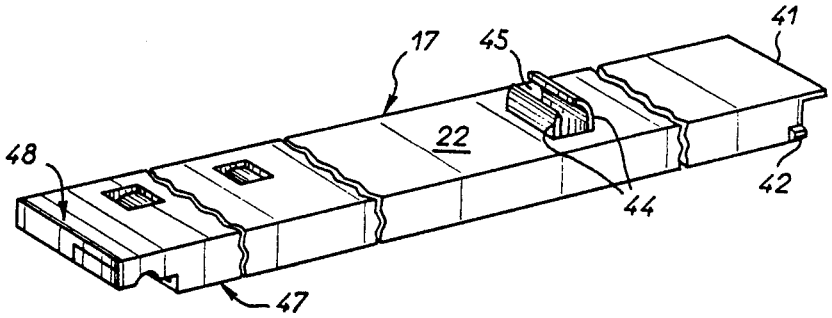
FIG. 2 is a perspective view of the dispenser seen from below.

As shown in dashed outline in the figures the wiring accessories 10 to be fitted comprise in addition to a metal shank 11 designed to be fitted over a previously stripped end 12 of a conductive core 13 of an electrical conductor 14 an insulative material collar 15 designed to fit over an insulative sheath 16 of the latter.

According to the invention a dispenser 17 is used to fit a wiring accessory 10 of this kind.

In the embodiment shown the dispenser 17 has a generally elongate plate-like configuration, to be more precise an overall parallelepiped shape.

It comprises a baseplate 22 on which is a projecting bar 23 extending transversely over a distance L1 which is less than the transverse width L2 of the baseplate 22 and which has in it a longitudinal groove 24 along its entire length parallel to said baseplate 22. It further comprises a lip 25 facing, parallel to and spaced from the longitudinal edge of said bar 23 into which the groove 24 opens.

The lip 25 borders one of the longitudinal edges of the baseplate 22. Relative to the lower surface of the latter it has a height H2 which is less than that H1 of the bar 23 which borders the opposite longitudinal side of the baseplate 22.

At one end of the bar 23 on an extension 26 of the baseplate 22 the dispenser 17 has a cradle 27 adapted to receive a wiring accessory 10. Projecting cantilever fashion and longitudinally from the bar 23 above and spaced from the cradle 27 is a finger 28 adapted to retain a wiring accessory 10 in the cradle 27.

The finger 28 extends from the branch 30 of the bar 23 farthest from the baseplate 22.

It extends only a short distance beyond the centerline of the cradle 27, to prevent it offering undue resistance to disengaging the wiring accessory 10 from it.

Figure 3:
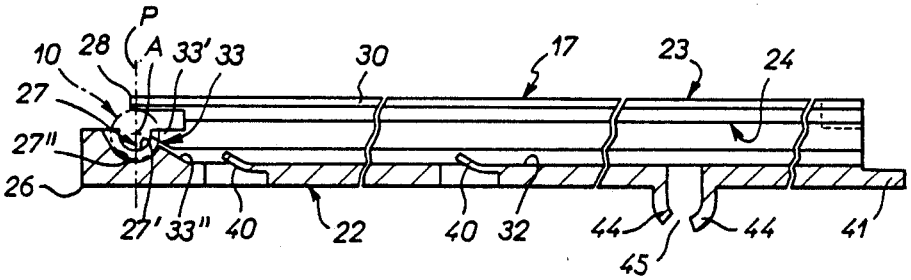
FIG. 3 is a partial view of it to a larger scale and in partial longitudinal cross-section on the line III—III in FIG. 1.
Figure 4:
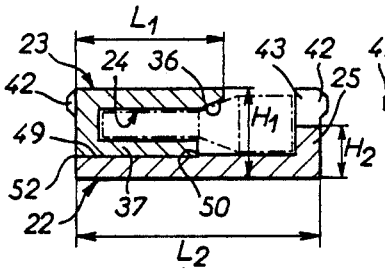
FIG. 4 is a view of it in transverse cross-section on the line IV—IV in FIG. 1.
Figure 7:
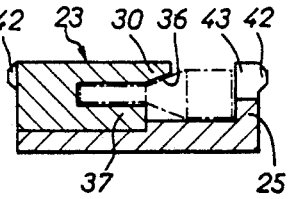
FIG. 7 is a view in transverse cross-section also analogous to that of FIG. 4 showing the adapter function of the dispenser.

The transverse plane P containing the centerline A of the cradle 27 is schematically represented in FIG. 3 by a dashed line.

Because of the shape of the wiring accessories 10 to be dispensed the cradle 27 is stepped with a smaller transverse cross-section part 27′ having the same dimensions as the shank 11 of an accessory in line with the bar 23 and a larger transverse cross-section part 27″ with the same dimensions as the insulative material collar 15 of an accessory in line with the free portion 32 of the baseplate 22, by which is meant the portion of the baseplate 22 between the bar 23 and the lip 25.

As shown here, the cradle 27 is preferably preceded by a ramp surface 33.

Like the cradle 27 the ramp surface 33 in the embodiment shown in FIGS. 1 through 5 is stepped with a part 33′ in line with the smaller transverse cross-section part 27′ of the cradle 27 and a part 33″ in line with the larger transverse cross-section part 27″ of the cradle 27.

The lip 25 extends along the full length of the baseplate 22. In line with the cradle 27 it has a notch 34.

The notch 34 is substantially semi-cylindrical.

As shown here, the notch 34 is preferably flanked by a notch in the lip 25.

As shown here, at least the branch 30 of the bar 23 farthest from the baseplate 22 preferably has its free edge bevelled by means of a chamfer 36 along all of its length and the same applies to the finger 28 which extends it.

In the embodiment specifically shown here, however, only this branch 30 is bevelled in this way by a chamfer of this kind.

As an alternative to this, however, the other branch 37 of the bar 23 may also have its free edge bevelled by a chamfer along all its length, if required.

The free portion 32 of the baseplate 22 has on its surface from which the bar 23 and the lip 25 project at least one longitudinally projecting detent carried by an elastically deformable tang 40.

In the embodiment shown in FIGS. 1 through 5 there are two appropriately spaced elastically deformable tangs 40 and the corresponding detent is formed by the raised end of one such elastically deformable tang 40.

To make the dispenser 17 easier to handle when it constitutes an adapter-loader its baseplate 22 comprises at the end opposite the cradle 27 an extension 41 in the form of a tab.

The lip 25 does not extend over this extension 41, although it does extend over the extension 26.

At the end opposite the cradle 27 the bar 23 and the baseplate 22 comprise respective snap-fastener means such as projections or recesses adapted to cooperate snap-fastener fashion with complementary snap-fastener means in the form of recesses or projections.

As far as the bar 23 is concerned the projection 42 is in one piece with its longitudinal edge opposite the lip 25, the projection 42 being in the immediate vicinity of the intersection between this longitudinal edge and the opposite surface of the baseplate 22.

As far as the lip 25 is concerned, the projection 42 is at the end of a finger 43 so that it is level with the other projection 42.

Projecting from the side of the baseplate 22 opposite that from which the elastically deformable tangs 40 project and at a distance from the elastically deformable tangs 40 are two elastically deformable blades 44 defining between them a transverse housing 45.

To facilitate molding the elastically deformable blades 44 and the previously mentioned elastically deformable tangs 40 flank holes through the baseplate 22.

Also to facilitate molding the bar 23 and the baseplate 22 are parts of respective separate flaps 47 and 48 fastened to each other in some suitable way.

The flap 48 comprises the lip 25 and the baseplate 22.

In the embodiment shown in FIGS. 1 through 5 the cradle 27 is divided between the two flaps 47 and 48 with its smaller transverse cross-section part 27′ on the flap 47 and its larger transverse cross-section part 27″ on the flap 48.

The flap 47 bears on a portion 49 of the baseplate 22 the surface of which is set back slightly relative to that of its free portion 32, being separated from the latter by a shoulder 50.

The flaps 47 and 48 are hinged together by a hinge line 52 extending along the edge of the baseplate 22 opposite that along which the lip 25 extends.

Figure 5:
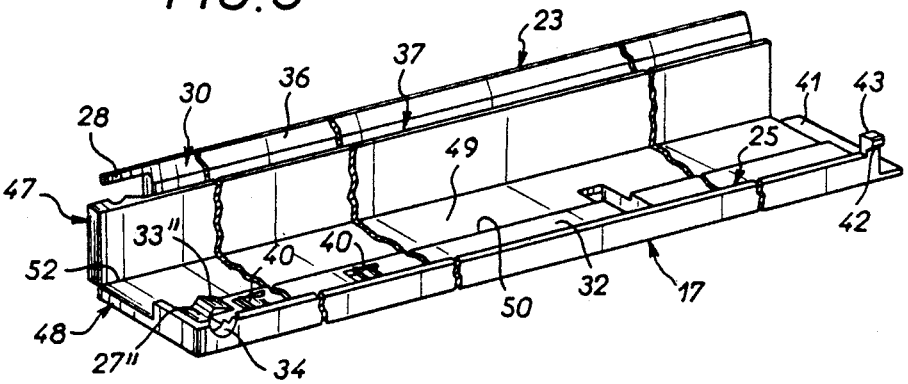
FIG. 5 is a view of it in perspective showing how it is molded.

As shown in FIG. 5 the loader dispenser 17 can therefore be molded by means of a mold with no mold slide in a configuration in which the flap 47 is substantially perpendicular to the flap 48.

After molding it is sufficient to fold the flap 47 against the flap 48 and fasten it thereto.

In the embodiment shown in FIGS. 1 through 5 the corresponding fastening is achieved by adhesive bonding, and the flap 47 and/or 48 can if required comprise one or more recesses (not shown) for receiving dabs of adhesive.

Fastening may also be achieved by welding, for example high-frequency welding, ultrasonic welding, spot heat welding or otherwise.

Figure 6:
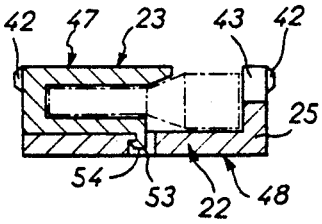
FIG. 6 is a view in transverse cross-section analogous to that of FIG. 4 relating to an alternative embodiment of the dispenser in accordance with the invention.

As an alternative to this (FIG. 6) it is the result of snap-fastener action, the flap 47 comprising spaced hooks 53, for example, by means of which it can engage snap-fastener fashion in the thickness of the baseplate 22 of the flap 48, over lugs 54 provided for this purpose, by means of openings in the baseplate 22.

When the flaps 47 and 48 constituting the dispenser 17 are applied one against the other it suffices to insert the wiring accessories 10 to be dispensed at one end of the loader and into the groove 24 of the bar 23 constituting its flap 47, as schematically represented in chain-dotted outline in FIG. 1, the groove 24 being longitudinally open at both ends.

Of course, the arrangements are such that the width of the groove 24 corresponds to the diameter of the metal shank 11 of the wiring accessories 10 and so that the distance between bar 23 and the lip 25 corresponds to the height of the insulative material collar 15.

As previously mentioned the dispenser 17 in accordance with the invention may be used in isolation.

The operator just has to use his thumb to push the wiring accessories 10 forward through the gap between the bar 23 and the lip 25 providing access to the insulative material collars 15, until the first wiring accessory passes over the ramp surface 33 to reach the cradle 27.

It is then appropriately retained by the finger 28.

It is then sufficient for the operator to insert the previously stripped end 12 of the conductive core 13 of the electrical conductor 14 into the wiring accessory 10 in the cradle 27, as schematically represented by the arrow F in FIG. 1.

When it is removed from the dispenser 17 the electrical conductor 14 takes with it the wiring accessory 10 into which it was previously inserted.

However, as also mentioned above the dispenser 17 in accordance with the invention can also be used as a loader adapter for a crimping tool which like that which is the subject matter of another patent application Serial No. 305,639 filed Feb. 3, 1989, has crimping jaws at the ends of two handles one of which forms a magazine adapted to receive it.

The outside dimensions of the dispenser in accordance with the invention are then matched to the inside dimensions of the corresponding magazine handle.

The projections 42 that it incorporates then cooperate snap-fastener fashion with complementary recesses provided for this purpose on the magazine handle and a hoop articulated to the latter is inserted into the housing 45 formed by the elastically deformable blades 44 on the back of the baseplate 22, to retain it more securely.

The dispenser 17 in accordance with the invention may therefore advantageously serve as an adapter for a crimping tool of this kind.

While having the same external dimensions adapted as already mentioned to the internal dimensions of the magazine handle of the crimping tool, the loader may have internal dimensions corresponding, at least within certain limits, to various possible different sizes of the wiring accessories 10 to be dispensed.

The wiring accessories are then preferably in strip form.

As will be readily understood the elastically deformable tangs 40 that it comprises yield elastically each time a wiring accessory 10 passes over them as a strip of this kind is advanced, opposing any retrograde movement of the strip.

As will also be readily understood when the dispenser 17 in accordance with the invention is used as a loader adapter for a crimping tool the tab which forms the extension 41 of the baseplate 22 advantageously facilitates its extraction when it must be changed either because the wiring accessories 10 that it initially contained have all been used or because it is necessary to change to a different size of wiring accessory.

Figure 8:
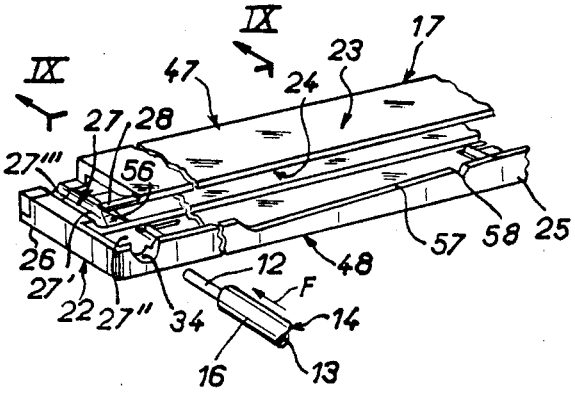
FIG. 8 is a partial view in perspective analogous to that of FIG. 1 showing an alternative embodiment.
Figure 9:
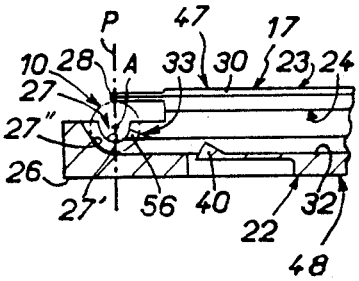
FIG. 9 is a partial view in cross-section analogous to that of FIG. 3 for this embodiment.

In the embodiment shown in FIGS. 8 and 9 the cradle 27 is carried by the flap 48 only with just a notch 27''' aligned with it on the flap 47; the end of the edge of the smaller transverse cross-section part 27' of the cradle 27 near the bar 23, at the outlet of the groove 24 therein, is provided with a slantwise edge 56 to facilitate the passage of the shank 12 of an accessory by tilting; the part 33'' of the ramp surface 33 is eliminated and the corresponding part 27'' of the cradle 27 is reduced to a quarter-cylinder surface running along the corresponding transverse edge of the free portion 32 of the baseplate 22; only the smaller transverse cross-section part 27' of the cradle 27 is then preceded by a ramp surface 33; the finger 28 is thinner, which advantageously confers some elasticity on it; the lip 25 includes a notch 57 which becomes deeper towards the cradle 27 to facilitate the pushing forward of the wiring accessories 10 by means of the thumb; the notch 57 is preceded by a detent 58 designed to mark the position of the most forwardly advanced wiring accessories 10; the elastically deformable tangs 40 being straight, the detent that they comprise is formed by a projecting bead at their end.

Of course, the present invention is not limited to the embodiments described and shown but encompasses any variant execution thereof.

There is claimed:

1. A dispenser for wiring accessories, the dispenser being of generally flat elongate configuration and comprising a baseplate, a bar overlying the baseplate and extending transversely across said baseplate a distance less than the entire width of said baseplate, said bar having a longitudinal groove parallel to said baseplate and running the full length of said baseplate, said longitudinal groove opening along a longitudinal edge of said bar, an upstanding lip on said baseplate disposed in parallel spaced relation with said one longitudinal edge of said bar, a longitudinal extension at one end of said baseplate, said extension having a transverse cradle for accommodating a wiring accessory, a longitudinal finger projecting cantilever-fashion from said bar and over said cradle for retaining a wiring accessory in said cradle.

2. The dispenser according to claim 1, wherein said bar comprises a pair of branches parallel to said baseplate, said longitudinal groove being defined between said branches, said finger projecting from one of said branches relatively farther from said baseplate.

3. The dispenser according to claim 1, wherein said cradle has a centerline and said finger projects only a short distance longitudinally beyond the centerline of said cradle.

4. The dispenser according to claim 1, wherein said cradle is stepped and comprises a smaller transverse cross-section part aligned with said bar and a larger transverse cross-section part aligned with the part of said baseplate between said bar and said lip.

5. The dispenser according to claim 4, having a direction of wiring accessory advance toward said cradle, further comprising a transverse ramp preceding the cradle and extending along at least part of the length of the cradle, said ramp having ramp portions longitudinally offset relative to each other.

6. The dispenser according to claim 1, having a direction of wiring accessory advance toward said cradle, further comprising a transverse ramp surface preceding the cradle and extending along at least part of the transverse length of the cradle.

7. The dispenser according to claim 1, wherein a notch is formed in said lip in alignment with said cradle.

8. The dispenser according to claim 1, wherein said bar has a pair of spaced branches parallel to said baseplate, each of the branches having a free edge, at least the branch farther from the baseplate having a chamfer running along the entire length of its free edge.

9. The dispenser according to claim 1, wherein a portion of said baseplate between said bar and said lip has an elastically deformable tang, a longitudinally projecting detent being carried by said tang.

10. The dispenser according to claim 1, wherein said baseplate has an extension at an end remote from said cradle.

11. The dispenser according to claim 1, wherein ends of said bar and said baseplate remote from said cradle comprise respective complementary snap-fastener means.

12. The dispenser according to claim 1, comprising separate flaps fastened together, one of said flaps incorporating said bar and the other of said flaps incorporating said baseplate.

13. The dispenser according to claim 12, wherein said flaps are articulate to each other by a hinge line extending along an edge of said baseplate remote from said lip.

14. The dispenser according to claim 12, wherein portions of said cradle are provided on the respective flaps.

15. The dispenser according to claim 12, wherein said cradle is provided on said other flap.

16. The dispenser according to claim 12, wherein said flaps are welded or adhesively bonded together.

17. The dispenser according to claim 12, further comprising means snap-fastening said flaps together.

* * * * *